US007114982B2

(12) United States Patent
Shimizu et al.

(10) Patent No.: US 7,114,982 B2
(45) Date of Patent: Oct. 3, 2006

(54) CONNECTOR WITH LOCK MECHANISM

(75) Inventors: Kazuomi Shimizu, Aichi (JP); Akihiko Onchi, Aichi (JP); Daisuke Miyachi, Aichi (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/037,185

(22) Filed: Jan. 19, 2005

(65) Prior Publication Data

US 2005/0181653 A1 Aug. 18, 2005

(30) Foreign Application Priority Data

Jan. 20, 2004 (JP) ..... 2004-012248

(51) Int. Cl.
*H01R 13/627* (2006.01)

(52) U.S. Cl. ..... 439/358

(58) Field of Classification Search ..... 439/350–353, 439/357, 358

See application file for complete search history.

(56) References Cited

U.S. PATENT DOCUMENTS

| | | | | |
|---|---|---|---|---|
| 4,828,510 | A | 5/1989 | Muzslay | |
| 5,378,168 | A * | 1/1995 | Sumida | 439/358 |
| 5,947,763 | A | 9/1999 | Alaksin et al. | |
| 6,024,594 | A * | 2/2000 | Self et al. | 439/358 |
| 6,250,942 | B1 | 6/2001 | Lemke et al. | |
| 6,358,091 | B1 | 3/2002 | Lo et al. | |
| 6,371,788 | B1 * | 4/2002 | Bowling et al. | 439/358 |
| 6,428,341 | B1 * | 8/2002 | Kinezuka et al. | 439/358 |
| 6,612,858 | B1 | 9/2003 | Stockhaus | |
| 6,655,980 | B1 * | 12/2003 | Lee | 439/358 |
| 6,692,289 | B1 * | 2/2004 | Nemoto | 439/352 |

FOREIGN PATENT DOCUMENTS

| | | | |
|---|---|---|---|
| DE | 31 05 808 A1 | 9/1982 | |
| DE | 3438 137 A1 * | 4/1986 | 439/358 |
| EP | 0 848 456 A | 6/1998 | |
| FR | 2 721 791 A | 12/1995 | |
| GB | 1 492 951 A | 11/1977 | |
| JP | 2-44269 U | 3/1990 | |
| JP | 5-251135 A | 9/1993 | |
| JP | 7-192810 A | 7/1995 | |
| JP | 08-222319 A | 8/1996 | |
| JP | 10-022004 A | 1/1998 | |
| JP | 10-334988 A | 12/1998 | |
| JP | 11-149957 A | 6/1999 | |
| JP | 11-251014 A | 9/1999 | |
| JP | 11-260481 A | 9/1999 | |

(Continued)

*Primary Examiner*—Tho D. Ta
(74) *Attorney, Agent, or Firm*—Rader, Fishman & Grauer PLLC

(57) ABSTRACT

A connector with a lock mechanism, in which maximum stress generated at a hinge joint as a fulcrum portion of a lock arm is reduced. A lock arm 3 is provided on an outer wall of a plug housing 10. A plug 1 comprises a lock mechanism 11, in which the lock arm 3 is latched on a latch 40 provided on a receptacle 2 for maintaining a state of coupling to the receptacle 2. The lock arm 3 comprises a hook 3A projecting in a direction of insertion of the receptacle 2, a point of pressure 3B (a finger depressing portion) positioned on an opposite side to the hook 3A, and a fulcrum portion 3C. The fulcrum portion 3C has a pair of torque rods 4A, 4B supporting the lock arm 3 at lateral ends so as to allow the hook 3A to swing.

8 Claims, 10 Drawing Sheets

FOREIGN PATENT DOCUMENTS

| | | | |
|---|---|---|---|
| JP | 11-288758 | A | 10/1999 |
| JP | 11-288762 | A | 10/1999 |
| JP | 2000-036360 | A | 2/2000 |
| JP | 2000-164294 | A | 6/2000 |
| JP | 2000-208183 | A | 7/2000 |
| JP | 2002-93495 | A | 3/2002 |
| JP | 2003-308920 | A | 10/2003 |

* cited by examiner

CONNECTOR WITH LOCK MECHANISM

CROSS-REFERENCE TO RELATED APPLICATIONS

This application is based upon and claims the benefits of priorities from Japanese Patent Application No. 2004-012248 filed on Jan. 20, 2004, the entire contents of which are incorporated herein by reference.

This application is related to a co-pending U.S. patent application entitled "Lock Structure and Connector with Lock Mechanism of Lock Structure," and being filed on even date herewith. The co-pending application is expressly incorporated herein by reference.

FIELD OF THE INVENTION

The present invention relates to a connector for electric connection, having a lock mechanism capable of mechanically holding on to a mating connector.

RELATED ART

A set of connectors for electric connection are constructed such that a connector, on which a socket contact with a plurality of cables is mounted, and a connector with a plurality of pin contacts are coupled to each other. In this case, a receptacle is mounted to an electric equipment or on a side of an electric equipment and a plug with cables is engaged with and disengaged from the receptacle.

A lock mechanism is in some cases provided in such connector for electric connection in order to make sure connection of the plug and the receptacle. In particular, plugs for cable connection are in many cases provided with a lock mechanism.

In such connector with a lock mechanism, a connector housing has been developed to comprise a flexible and durable hinge joint for lock arms, which is capable of enduring stress and torque and allows repeated flexure of a lock arm (for example, see JP-A-5-251135).

The disclosure of JP-A-5-251135 has a feature that a hook member is joined integrally to a side of a connector housing by a hinge joint, and the hinge joint comprises a central portion and ribs positioned at first and second ends, respectively, of the central portion to extend between the hook member and the side.

As such connector with a lock mechanism, a connector has been developed to solve a problem that two slide dies are conventionally necessary in molding outer walls of a connector housing with a lock mechanism to cause a high manufacturing cost (for example, see JP-A-2000-164294).

In JP-A-2000-164294 described above, an intermediate portion of a lock arm in the lock mechanism is supported by a support to be able to elastically perform swinging displacements. The lock arm includes a first portion positioned relative to the support in a connection direction and a second portion positioned in an opposite direction to the connection direction. The first portion includes a hook and the second portion includes a finger depressing portion.

FIG. 9 is a perspective view showing a connector housing including a pair of lock arms joined together by a hinge joint in the invention described in JP-A-5-251135. FIG. 9 in the present application corresponds to FIG. 1 in JP-A-5-251135.

Also, FIG. 10 is a plan view showing a connector housing in the course of fitting to a mating connector housing in the invention described in JP-A-5-251135. FIG. 10 in the present application corresponds to FIG. 6 in JP-A-5-251135.

In FIG. 9, a plug connector 8A comprises a block 80 made of an insulating material such as nylon, etc. and having a fitting surface 80A and a rear surface 80B. A plurality of contact accommodation chambers 80C extend axially from the rear surface 80B to the fitting surface 80A within the block 80 to receive contacts pressed onto electric cables. The plug connector 8A accommodates therein a contact socket that receives projecting ends of contact pins accommodated in a receptacle connector 8B (see FIG. 10) of a connector assembly.

In FIG. 9, the block 80 has upper and lower surfaces, and both sides provided with a pair of lock arms 81A, 81B. The pair of lock arms 81A, 81B comprise a substantially flat plate, and are joined integrally to respective sides of the housing by flexible, integral hinge joints 81C, 81D positioned substantially midway along the pair of lock arms 81A, 81B.

The pair of lock arms 81A, 81B comprise a pair of forward portions terminating at free ends, which are provided with a pair of hooks 81E, 81F. The pair of forward portions, respectively, includes a groove 81G, 81H extending from a nearest hinge joint 81C, 81D to the hook 81E, 81F.

The pair of lock arms 81A, 81B further comprise a rear portion 81J, 81K extending rearward from the hinge joint 81C, 81D. The rear portion 81J, 81K is shaped to enable a user to clench the rear portions 81J, 81K to separate the plug connector 8A from the receptacle connector 8B.

As shown in FIG. 10, when the both connectors are to fit together, the hooks 81E, 81F bend outward as they ride over latch projecting ends 82C, 82D of latches 82A, 82B. Since the hooks 81E, 81F move on the latch projecting ends 82C, 82D, the latch projection ends 82C, 82D are positioned in the grooves 81G, 81H (see FIG. 9). In this position, shoulders of the pair of lock arms 81A, 81B cooperate with shoulders of the latches 82A, 82B to prevent accidental release of latch caused by stress and vibrations in the fitted state of the connectors.

As shown in FIG. 10, free ends of the hooks 81E, 81F are inclined to engage with slopes of the latch projecting ends 82C, 82D, so that the pair of lock arms 81A, 81B begin to bend outward along the slopes. When fitting is to be released, the rear portions 81J, 81K of the pair of lock arms 81A, 81B are driven in directions, in which they approach each other, so that the lock arms 81A, 81B are turned about the respective hinge joints 81C, 81D. Thereby, the hooks 81E, 81F and the latch projecting ends 82C, 82D are disengaged from each other, so that the plug connector 8A is moved rearward to be able to separate from the receptacle connector 8B.

In this manner, the plug connector 8A comprises the pair of lock arms 81A, 81B that are latched on latch means of a mating connector along the sides thereof. The respective lock arms 81A, 81B are joined integrally to the sides of the housing by means of the flexible hinge joints 81C, 81D that afford flexure of the lock arms 81A, 81B at the time of fitting and release of fitting.

In the invention described in JP-A-5-251135, the hinge joints 81C, 81D comprise a "dogbone" central portion having a rib. The rib is formed with an arcuate portion, and the rib appropriately disperses stress caused by the action of the pair of lock arms 81A, 81B with the result that it is assumed that stress concentration at the hinge joints can be prevented when external forces are applied to the lock arms 81A, 81B.

According to the invention described in JP-A-5-251135, stress distribution is achieved by making the hinge joints flexible and adopting "dogbone" hinge joints as a fundamental shape so as to eliminate damages.

However, a change of design is in some cases desired such that a hinge joint making a fulcrum portion of a lock arm is shifted toward a hook to further enlarge an opening at the hook. In this case, since a distance from the hinge joint making a fulcrum portion to a rear portion making a point of pressure is lengthened, it is necessary to increase, for example, a thickness of the rear portion to provide the rigid rear portion having a large geometrical moment of inertia so that a terminal end of the rear portion is not bent.

That is, a change of design such as an increase in thickness of a lock arm becomes complicated. There has been demanded a lock mechanism constructed such that a fulcrum portion of a lock arm is easily changed in position without thinking of such complicated change, and maximum stress generated at a hinge joint, which makes a fulcrum portion of the lock arm, accompanying the motion of the lock arm is decreased, and a connector provided with such lock mechanism.

FIG. 11 is a schematic, perspective view showing a socket connector as a connector with a lock mechanism and a base connector as a mating connector in the invention described in JP-A-2000-164294. FIG. 11 in the present application corresponds to FIG. 1 in JP-A-2000-164294. Also, FIG. 12 is a vertical, cross sectional view showing both connectors in a coupled state in the invention described in JP-A-2000-164294. FIG. 12 in the present application corresponds to FIG. 3 in JP-A-2000-164294.

In FIG. 11, a base connector 9B is fixed to a surface of a printed board 90. A socket connector 9A is mounted to ends of a plurality of cables 9C arranged in parallel. The socket connector 9A is coupled to the base connector 9B.

The base connector 9B comprises a base housing 91 made of a synthetic resin and a plurality of terminals 91A. The plurality of terminals 91A extend through the base housing 91 and are arranged laterally. The terminals 91A projecting downwardly of the base housing 91 are fixed at tip ends thereof to the printed board 90 by means of soldering.

The base housing 91 is opened at an end surface on a coupled side thereof and comprises an insertion and extraction recess 91B to permit insertion and extraction of a part of a corresponding mating socket connector 9A. The plurality of terminals 91A are aligned and arranged in the insertion and extraction recess 91B.

A pair of engagement projections 93A and 93B are formed on an outer wall surface of the base housing 91. The pair of engagement projections 93A and 93B are latched on and engaged by hooks 92A and 92B of a lock mechanism 92 on a side of the socket connector 9A. The pair of engagement projections 93A and 93B are formed in recesses 93C and 93D on both sides with a vertical rib 93L therebetween.

Since the respective engagement projections 93A and 93B are formed over entire widths of the corresponding recesses 93C and 93D, strength in these portions is enhanced. The respective engagement projections 93A and 93B comprise inclined guides 93E and 93F for guiding of engagement of the hooks 92A and 92B.

On the other hand, provided on an outer wall surface of a socket housing 94 is a plate-shaped lock arm 92L, which is arranged in parallel to the outer wall surface. A pair of supports 92M (see FIG. 12) projectingly formed on the outer wall surface elastically support an intermediate portion of the lock arm 92L to make the same capable of swinging displacement. The pair of supports 92M connect both widthwise sides of the lock arm 92L to the outer wall surface of the socket housing 94.

As shown in FIG. 12, the lock arm 92L comprises a first portion 921 positioned relative to the supports 92M in a direction A of mounting to the mating base connector 9B, and a second portion 922 positioned relative to the supports 92M in a direction B opposed to the mounting direction. The first portion 921 includes hooks 92A and 92B being latched on and engaged by the engagement projections 93A and 93B of the mating bass connector 9B. The second portion 922 includes a finger depressing portion 92F. The hooks 92A and 92B are provided over an entire width of the first portion 921 to achieve an increase in strength of the first portion 921.

In this manner, the supports 92M elastically support the intermediate portion of the lock arm 92L on the lock mechanism 92 to make the same capable of swinging displacement. The lock arm 92L includes the first portion 921 positioned relative to the supports 92M in the mounting direction A, and the second portion 922 positioned in the direction B opposed to the mounting direction.

The invention described in JP-A-2000-164294 also involves the same structural problem of a lock arm as that in JP-A-5-251135. In the invention described in JP-A-2000-164294, a bending moment acts on supports, which make a fulcrum portion of a lock arm, as the lock arm operates. That is, the supports cause compressive stresses to act on a finger depressing portion, which makes a point of pressure, and tensile stresses to act on a hook, which makes a point of action.

With small-sized connectors or connectors having a small height, the supports are small in rise, that is, the supports would possibly make rigid arms having a large geometrical moment of inertia. When the lock arm is operated with a large force, an outer wall (housing), in particular, an outer wall of a thin wall thickness, joined to the support would possibly be turned up on a side, on which tensile stress acts, and sink on a side, on which compressive stress acts, when the finger depressing portion is operated.

With a connector, in which a hook can be opened and closed with a relatively weak force and which includes an outer wall having a small wall thickness, there have been demanded a lock mechanism structured to have no influences on the outer wall and to further decrease maximum stress generated on a support, which makes a fulcrum portion of a lock arm, and a connector with the lock mechanism.

SUMMARY OF THE INVENTION

In order to solve the problems described above, it is an object of the present invention to provide a connector with a lock mechanism having a lock arm, the lock mechanism being constructed such that a fulcrum portion of the lock arm is easily changed in position and maximum stress generated on a hinge joint, which makes the fulcrum portion of the lock arm, may be further decreased.

In order to attain the object, the inventors of the present application have devised the following new connector with a lock mechanism, in which a fulcrum portion of a lock arm is supported at both lateral ends thereof by torque rods.

(1) A connector with a lock mechanism, the lock mechanism comprising a lock arm being provided on an outer wall of a housing of the connector wherein the lock arm is latched on a latch provided on a mating connector so as to maintain a state that the connector is coupled with the mating connector; wherein the lock arm comprises a hook being disposed on a front end and extending in a direction of insertion of the mating connector, a point of pressure disposed on a rear end opposite to the front end, the point of pressure including a finger depressing portion, and a fulcrum portion positioned between the hook and the point of pressure; and wherein the fulcrum portion of the lock arm is supported at both lateral ends thereof by a pair of torque rods so as to allow the hook to swing.

(2) The connector with the lock mechanism according to (1), wherein a pair of flanges are disposed under the fulcrum portion at the lateral ends across the lock arm in opposition to each other such that the fulcrum portion is supported by the pair of torque rods via the pair of flanges.

(3) The connector with the lock mechanism according to (1) or (2), wherein the lock mechanism further comprises a pair of supports projecting from an outer wall of the housing to be arranged near the lateral ends of the lock arm, and wherein the pair of supports are joined to the pair of torque rods supporting the fulcrum portion at the lateral ends.

(4) The connector with the lock mechanism according to (3), wherein the housing, the lock arm, the pair of torque rods, and the pair of supports are molded integrally from an insulating synthetic resin.

(5) The connector with the lock mechanism according to any one from (1) to (4), wherein the lock mechanism having the pair of torque rods supporting the fulcrum portion of the lock arm at the lateral ends so as to allow the hook to swing is arranged on each side of the housing.

(6) The connector with a lock mechanism according to any one from (1) to (4), wherein the lock mechanism having the pair of torque rods supporting the fulcrum portion of the lock arm at the lateral ends so as to allow the hook to swing is arranged on one of the outer walls of the housing.

(7) The connector with a lock mechanism according to any one from (1) to (6), wherein the pair of torque rods are formed in a substantially column shape.

(8) The connector with a lock mechanism according to any one from (1) to (8), wherein the pair of torque rods are formed from a bulged column, which is larger in diameter at an intermediate portion thereof than at both ends fixedly supported.

(9) The connector with a lock mechanism according to any one from (1) to (6), wherein a cross section at an axis of the pair of torque rods forms a near ellipse, of which a major axis is in parallel to a direction of insertion of a mating connector and a minor axis is perpendicular to the direction of insertion of the mating connector, and the pair of torque rods are formed in a nearly elliptical column shape.

(10) The connector with a lock mechanism according to (7), wherein the pair of torque rods are formed in the substantially column shape, the substantially column shape having a longitudinal flat cut surface such that the cut surface is flush with an upper surface of the lock arm.

(11) A connector with a lock mechanism, the lock mechanism maintaining a state of being coupled with a mating connector by engaging the connector with a latch of the mating connector, the lock mechanism comprising: a lock arm comprising a hook near a front end thereof, the hook being engaged with the latch of the mating connector; a pair of torque rods for supporting the lock arm at both lateral ends so as to allow the hook to swing; and a pair of supports joined to respective distal ends of the pair of torque rods, wherein the lock mechanism is integrally molded; wherein the lock arm comprises the front end arranged toward the mating connector in a direction of engagement with the mating connector and a rear end on an opposite side to the front end, and when the rear end is caused to swing, the hook swings about the pair of torque rods as a fulcrum; and wherein the supports are joined to a outer wall of the connector so as to keep sufficient clearances from the lock arm.

(12) The connector with the lock mechanism, according to (11), wherein the lock mechanism further comprises a point of pressure provided in a vicinity of the rear end to protrude outward from the connector.

(13) The connector with the lock mechanism, according to (11) or (12), wherein the lock mechanism is provided on both sides of the connector via the supports.

(14) A mating connector being coupled to the connector with the lock mechanism as defined in any one from (1) to (13).

According to the present invention according to (1), a connector may include a lock mechanism, which includes a lock arm provided on outer walls of a housing and in which the lock arm is latched on a latch provided on a mating connector to thereby maintain a state of being coupled to the mating connector. The lock arm may be composed of a hook projecting in a direction of insertion of the mating connector, a point of pressure positioned on an opposite side to the hook and including a finger depressing portion, and a fulcrum portion positioned between the hook and the point of pressure. The fulcrum portion of the lock arm may be supported at both ends thereof by a pair of torque rods so as to permit the hook to swing.

The lock mechanism, which includes a lock arm provided on outer walls of a housing, may be arranged in pair on both wings (or both sides) of the housing in an opposite manner, or may be arranged singly on one of the outer walls of the housing. The connector may be a rectangular-shaped one or a round-shaped one.

A mating connector may be a rectangular-shaped one mounted on an apparatus, which includes a panel, or a rectangular-shaped one for a printed board, which is mounted to a printed board. A rectangular-shaped connector being coupled to a rectangular-shaped connector, which makes a mating connector, may be a rectangular-shaped one with cables, and the cables may comprise flat cables. Also, a mating connector may be one with cables, and the connector according to the present invention may be one with cables.

According to the present invention, the connector may comprise a plug and a mating connector may comprise a receptacle, while the connector according to the present invention may comprise a receptacle and a mating connector may comprise a plug. While a shell-type multipolar plug ordinarily has female contacts inserted thereinto and a mating shell-type multipolar receptacle has male contacts inserted thereinto, male contacts may be inserted into a plug and male contacts may be inserted into a receptacle.

The swinging front end of the lock arm may comprise a saw-toothed (or wedge-shaped) hook, and the hook is latched on and engaged by a mountainously (or triangularly as viewed laterally) protruding latch whereby the connector and a mating connector are locked together. In addition, a latch for engagement with the saw-toothed hook may comprise a saw-toothed recess, and the hook may be configured such that a rectangular hole is formed in the hook and the rectangular hole engages with the saw-toothed latch.

The torque rods supporting a fulcrum portion of the lock arm at both ends thereof are ones exerted by a twisting torque, and the formation of the torque rods from hollow tubes is admitted. Also, the torque rods are not limited to round bars (column) but may comprise bulged columns, near columns, prisms, and columns, and a part of the columns may be cut off arcuately, as described in the embodiment described later.

While a bending moment caused by flexure acts on a fulcrum portion of a conventional lock arm, the present invention has a feature that torsional moment acts on a fulcrum portion of a lock arm.

It has been analyzed that maximum stress caused by torsional moment at a fulcrum portion of a lock arm is smaller than maximum stress caused by bending moment. That is, as compared with a conventional lock arm that makes use of flexure, the lock arm, according to the present invention, making use of twist has an advantage that maximum stress generated at a fulcrum portion is less.

A lock mechanism, according to the present invention, in which a fulcrum portion of a lock arm is supported at both ends thereof by torque rods, can change the fulcrum portion of the lock arm in position without changing a wall thickness of the lock arm. Also, a connector with a lock mechanism, constructed such that maximum stress generated at a fulcrum portion of a lock arm is small is made possible. That is, it is possible to realize a connector with a lock mechanism, in which a lock arm can be operated with a relatively weak force and which has no influences on outer walls of a housing, in particular, a connector with a lock mechanism, useful for connectors being small in size and low in height.

According to the present invention according to (2), the fulcrum portion of the lock arm may be provided downward on the lock arm so that a pair of flanges are opposed to each other, and the pair of flanges provided downward on the fulcrum portion of the lock arm so as to permit the hook to swing may be supported at both ends thereof by the pair of torque rods.

Since the lock mechanism according to the present invention allows the lock arm to be operated by a relatively weak force, flexure of the hook and the point of pressure, which make a finger depressing portion, is eliminated even when the lock arm is made small in thickness. With such lock mechanism, by providing the pair of flanges downward on the fulcrum portion of the lock arm, that is, by lowering the fulcrum portion, an angle, at which the hook opens and closed, can be further increased. This contributes to making a state of being mounted to a mating connector further firm, According to the present invention, as described in (3), a pair of supports projecting from outer walls of the housing to be arranged on both wings (or sides) of the lock arm may be provided, and the pair of supports may be joined to the pair of torque rods, which support the fulcrum portion of the lock arm at both ends thereof.

The pair of supports may be formed projectingly in a rectangular-prism shaped manner to be protuberant from outer walls of the housing, or formed projectingly in a trapezoidal manner such that a lower side is wider than an upper side. Also, the pair of supports may be formed projectingly in a flanged manner so as to be made flush with the outer walls of the connector body.

Respective axes of the pair of torque rods are common to each other, and the pair of torque rods project oppositely from both wings of the lock arm. Also, the pair of supports are supported at both ends thereof by the pair of torque rods, in other words, both ends of the pair of torque rods are fixedly supported.

According to the present invention, as described in (4), the housing, the lock arm, the pair of torque rods, and the pair of supports may be molded integrally from an insulating synthetic resin.

In integrally molding the housing, the lock arm, the pair of torque rods, and the pair of supports from an insulating synthetic resin, it is desired that the connector according to the present invention be constructed to be easy to mold without the need of many metal dies.

With the connector with a lock mechanism, according to the present invention, in a preferred embodiment, the lock mechanism having the pair of torque rods supporting a fulcrum portion of the lock arm at both ends thereof so that the hook swings may be provided on both wings of the housing.

Also, with the connector with a lock mechanism, according to the present invention, in a further preferred embodiment, the lock mechanism having the pair of torque rods supporting a fulcrum portion of the lock arm at both ends thereof so that the hook swings may be provided on one of outer walls of the housing.

The torque rods that constitute the lock mechanism according to the present invention may comprise a simple column (near column) in a preferred embodiment, and the torque rods in a further preferred embodiment may comprise a bulged column in order to make stress concentration, which is generated on the torque rods, even. In addition, the bulged column does not mean a state, in which a column is expanded, but assumes a shape of a buckled column.

Also, as a further preferred embodiment, in order to make a connector small in height or size, the torque rods may be in the form of a nearly elliptical column, or may be in the form of a column, which is cut off arcuately so as to be made flush with an upper surface of the lock arm.

The connector with a lock mechanism, according to the present invention, which is molded from an insulating synthetic resin may be molded from polybutylene terephthalate (referred below to as PBT).

Since PBT has a high melting point and a high degree of crystallinity and a low absorption coefficient of water and a low coefficient of thermal expansion, it exhibits an excellent dimensional stability. Also, PBT has a feature to be excellent in electric insulation, small in change in electric characteristics, which is caused due to moisture absorption, and high in dielectric breakdown voltage.

The connector with a lock mechanism, according to the present invention, has an advantage that since a fulcrum portion of a lock arm being latched on a latch provided on a mating connector is supported at both ends thereof by torque rods, maximum stress generated on the fulcrum portion of the lock arm is small. Thus it is possible to realize a connector with a lock mechanism, in which a lock arm can be operated with a relatively weak force and which has no influences on outer walls of a housing, in particular, a connector with a lock mechanism, useful for connectors being small in size and low in height.

A lock mechanism, according to the present invention, in which a fulcrum portion of a lock arm is supported at both ends thereof by torque rods, can change the fulcrum portion of the lock arm in position without changing a wall thickness of the lock arm.

Further features of the present invention, its nature, and various advantages will be more apparent from the accompanying drawings and the following detailed description of the present invention.

BRIEF DESCRIPTION OF THE DRAWINGS

FIG. 9 in the present application corresponds to FIG. 1 in JP-A-5-251135.

FIG. 10 in the present application corresponds to FIG. 6 in JP-A-5-251135.

FIG. 11 in the present application corresponds to FIG. 1 in JP-A-2000-164294.

FIG. 12 in the present application corresponds to FIG. 3 in JP-A-2000-164294.

DESCRIPTION OF THE PREFERRED EMBODIMENT

The preferred embodiment of the present invention will be described below in reference to the drawings. However, the present invention is not limited to the embodiment, and various modifications and changes in design can be made without departing from the scope of the invention.

Figure 1:
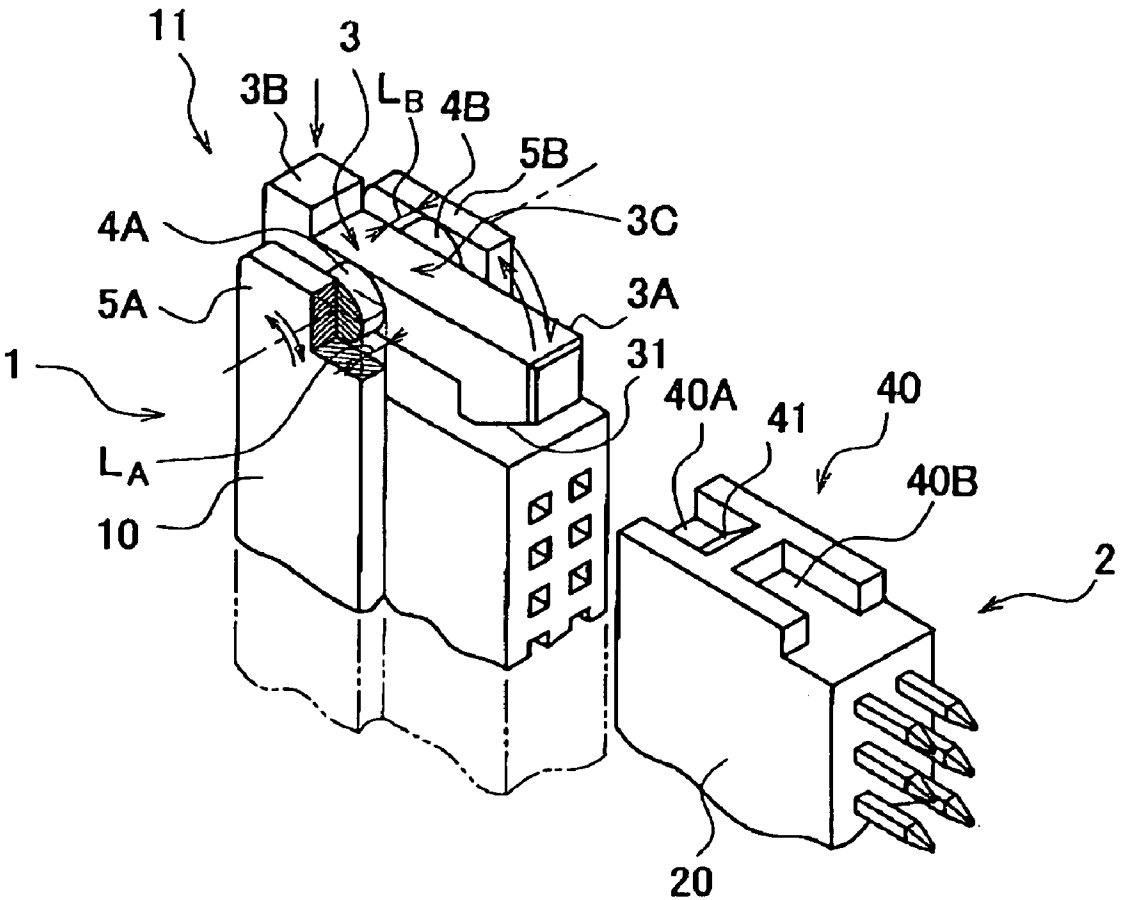
FIG. 1 is a perspective view showing a connector with a lock mechanism according to an embodiment of the present invention.

FIG. 1 is a perspective view showing a part of a connector with a lock mechanism according to an embodiment of the present invention. FIG. 1 depicts only main parts. In FIG. 1, the reference numeral 1 denotes a plug to perform as a connector of the present invention, 2 denotes a receptacle to perform as a mating connector, and 11 denote a lock mechanism.

In the embodiment shown in FIG. 1, the plug 1 comprises a shell-type multipolar, rectangular connector. A plug housing 10 has an outer shell molded from an insulating synthetic resin to be rectangular in shape. The plug housing 10 is connected thereto a plurality of "female" contacts with cables.

On the other hand, in the embodiment shown in FIG. 1, a receptacle 2 comprises a shell-type multipolar, rectangular connector, the receptacle 2 comprising a connector for a printed board, which is mounted to a printed board. A receptacle housing 20 has an outer shell molded from an insulating synthetic resin to be rectangular in shape. The receptacle housing 20 is connected to a plurality of "male" contacts, which are to couple with the "female" contacts connected to the plug 1.

The lock mechanisms 11 includes a lock arm 3 provided on outer walls of the plug housing 10. The lock arm 3 comprises a hook 3A projecting in a direction, in which the receptacle 2 is inserted. A point of pressure 3B is positioned in opposition to the hook 3A to comprise a finger depressing portion. A fulcrum portion 3C is positioned between the hook 3A and the point of pressure 3B.

In the embodiment shown in FIG. 1, the lock arm 3 is composed of the hook 3A, the point of pressure 3B, and the fulcrum portion 3C. The fulcrum portion 3C has the lock arm 3 supported at both ends thereof by a pair of torque rods 4A and 4B so that the hook 3A can swing (or turn).

In the embodiment shown in FIG. 1, the plug housing 10 comprises a pair of supports 5A and 5B. The pair of supports 5A and 5B project from the outer walls of the plug housing 10 and are arranged on both wings (or both sides) of the plug housing 10. The pair of supports 5A and 5B are joined to the pair of torque rods 4A and 4B, which support the lock arm 3 at both ends thereof. The supports 5A and 5B support the lock arm 3 by means of the pair of torque rods 4A and 4B so as to provide sufficient clearances on an upper surface and a lower surface of the lock arm to enable the lock arm 3 to turn lo about the fulcrum portion 3C.

In FIG. 1, the plug housing 10, the lock arms 3, the pair of torque rods 4A and 4B, and the pair of supports 5A and 5B are molded integrally from an insulating synthetic resin, for example, PBT or the like.

On the other hand, in the embodiment shown in FIG. 1, the receptacle 2 comprises latches 40. Since the lock arms 3 are latched on the latches 40, a state, in which the plug 1 and the receptacle 2 are coupled together, is maintained.

In the embodiment shown in FIG. 1, the latches 40 are provided on outer walls of the receptacle housing 20. The latches 40 comprise a guide 40A opened in a direction, in which the plug 1 is inserted. A latch portion 40B is positioned in opposition to the guide 40A and defined by a thin, rectangular-shaped recess.

In FIG. 1, when the plug 1 is moved in a direction of mounting in order to fit the plug 1 onto the receptacle 2, a slope 31 formed on the saw-toothed hook 3A slides on and rides over a slope 41 formed on the guide 40A, so that the hook 3A rises upward in the figure with the fulcrum portion 3C as a center of rotation.

When the plug 1 is further moved in the direction of mounting, elastic return forces of the pair of torque rods 4A and 4B cause the hook 3A to sink in the latch portion 40B, so that a state, in which the plug 1 and the receptacle 2 are coupled together, is maintained.

A state, in which the plug 1 and the receptacle 2 are coupled together, can be released by pushing the point of pressure 3B, which make a finger depressing portion, and moving the plug 1 in a direction opposed to the direction of mounting in a state, in which the hook 3A is raised upward with the fulcrum portion 3C as a center of rotation.

In this manner, with the lock mechanism according to the present invention, the pair of torque rods supporting the fulcrum portion of the lock arm at both ends thereof are twisted within a limit of elastic deformation whereby the hook provided at a front end of the lock arm is opened and closed. With the lock mechanism according to the present invention, the lock arm can be operated by a relatively weak force.

Figure 10:
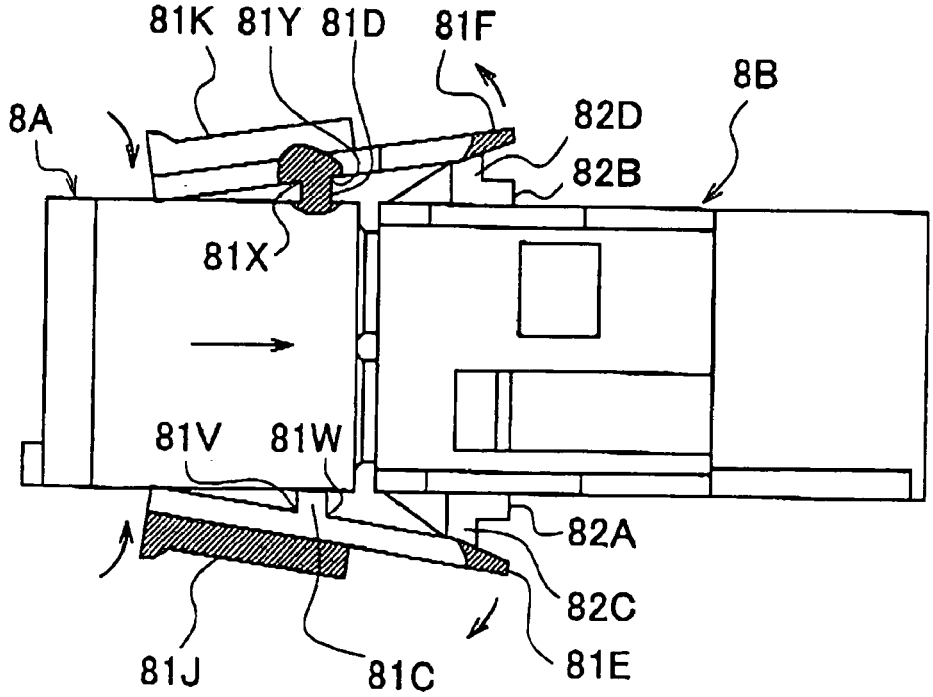
FIG. 10 is a plan view showing a connector housing in the course of fitting with a mating connector housing as described in JP-A-5-251135.
Figure 11:
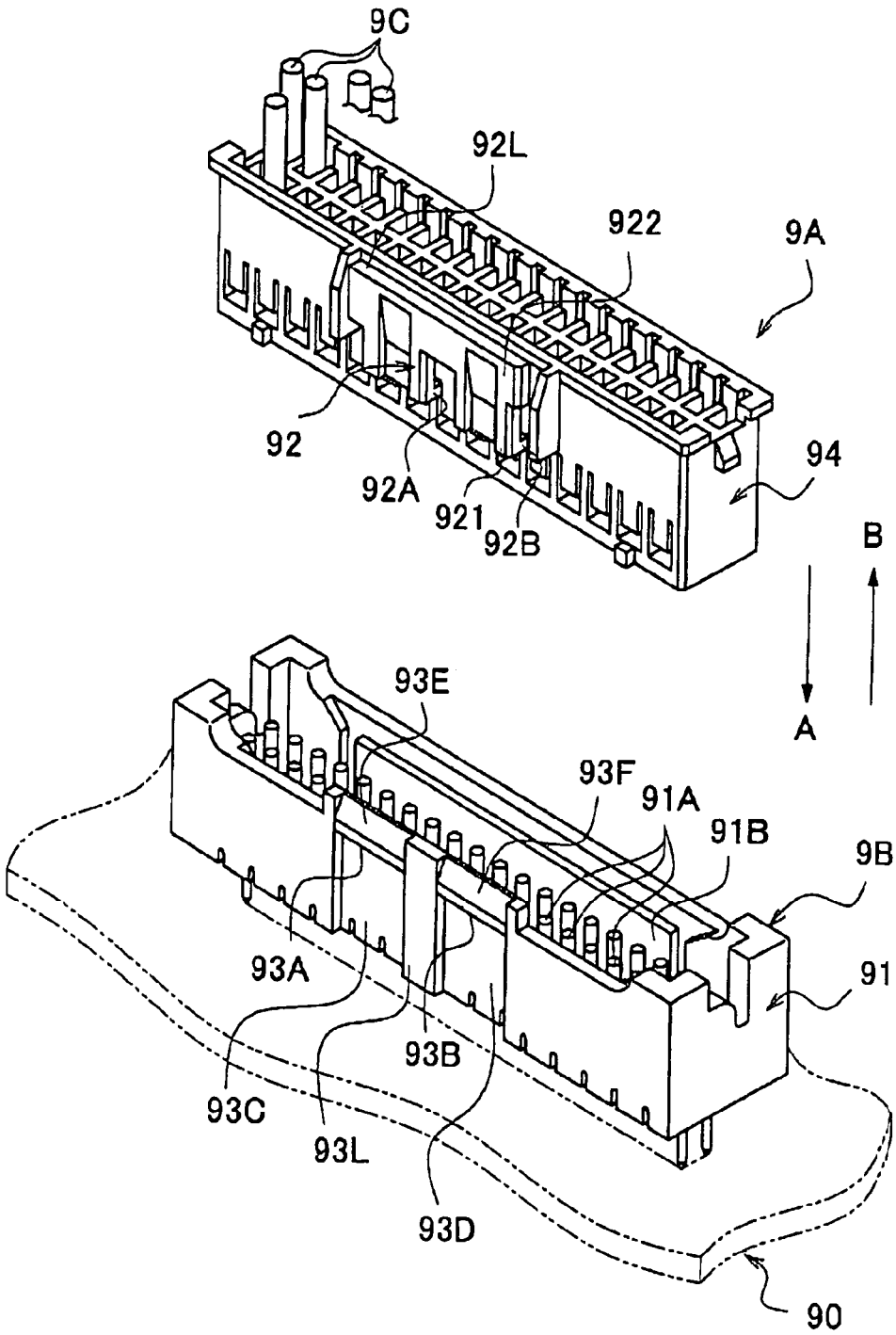
FIG. 11 is a schematic, perspective view showing a socket connector as a connector with a lock mechanism and a base connector as a pairing connector as described in JP-A-2000-164294.
Figure 12:
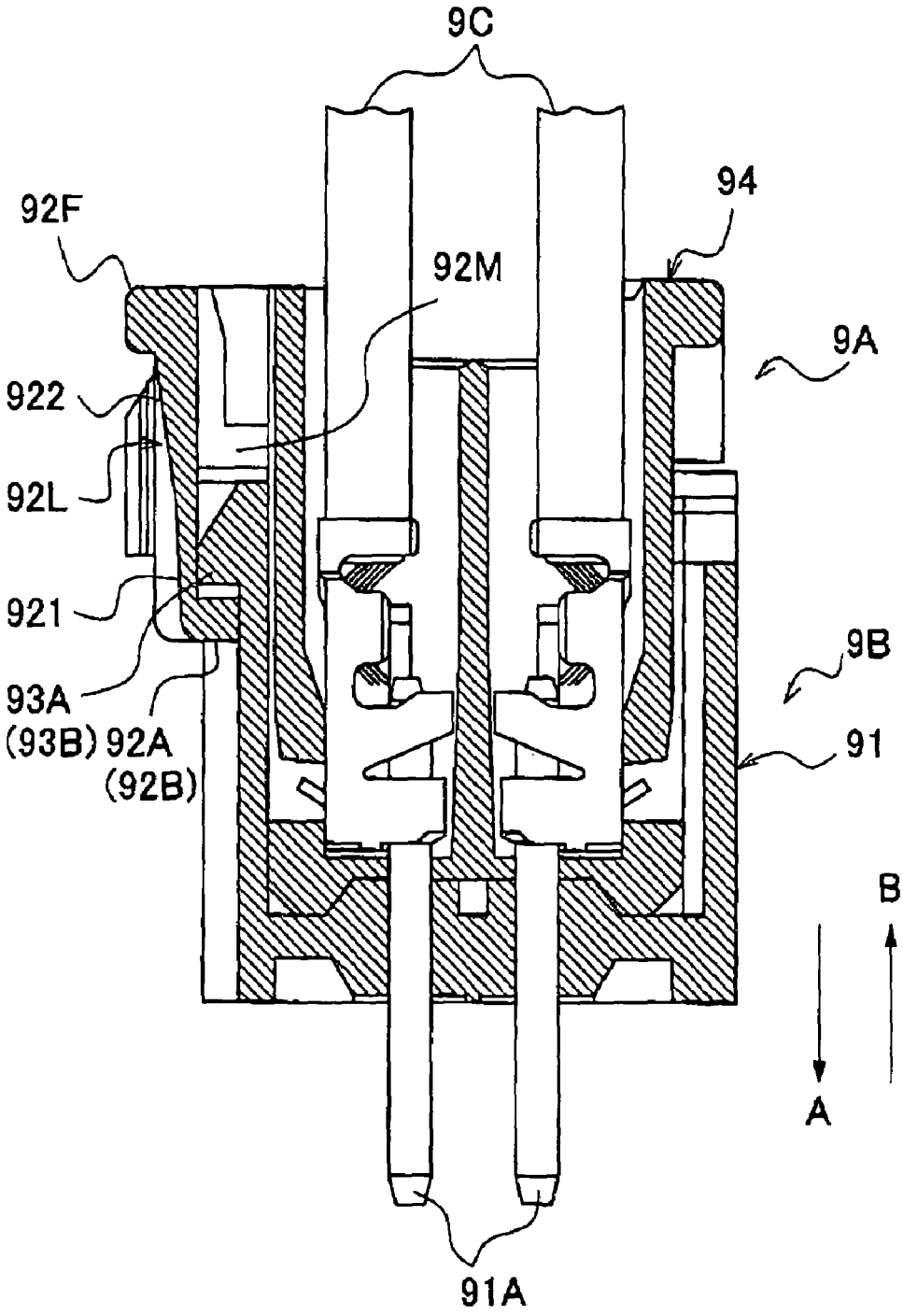
FIG. 12 is a vertical, cross sectional view showing both connectors in a coupled state as described in JP-A-2000-164294.

A mechanism as deduced will be described with reference to FIGS. 10 and 1. In FIG. 10, a pair of lock arms 81A, 81B are joined integrally to respective sides of a housing by flexible, integral hinge joints 81C, 810 positioned substantially midway along the lock arms. At this time, the strut portions 81C, 81D serve to separate the lock arms 81A, 81B from the respective sides of the housing so as to allow the lock arms 81A, 81B to swing, and corners 81V, 81X at forward ends and corners 81W, 81Y at rearward ends, respectively, make compressive and tensile deformations to thereby allow the lock arms 81A, 81B to swing. Accordingly, while it is desired that even when being applied by push forces, the strut portions 81C, 81D being integral hinge joints resist the push forces to make less deformations so as to separate the lock arms 81A, 81B from the respective sides of the housing, the respective corners 81V, 81X and corners 81W, 81Y are preferably flexible. It is generally thought difficult to make such flexibility and deformation resistance compatible with each other. On the other hand, with the case in FIG. 1, it suffices that the pair of torque rods 4A and 4B make twisting deformation over predetermined distances $L_A$ and $L_B$, and a push force is met by deformation or the like of the support 5A, which is caused by bending, tension, etc. of the pair of torque rods 4A and 4B, so that with a flexible material, it is thought relatively easy to cope.

Figure 2:
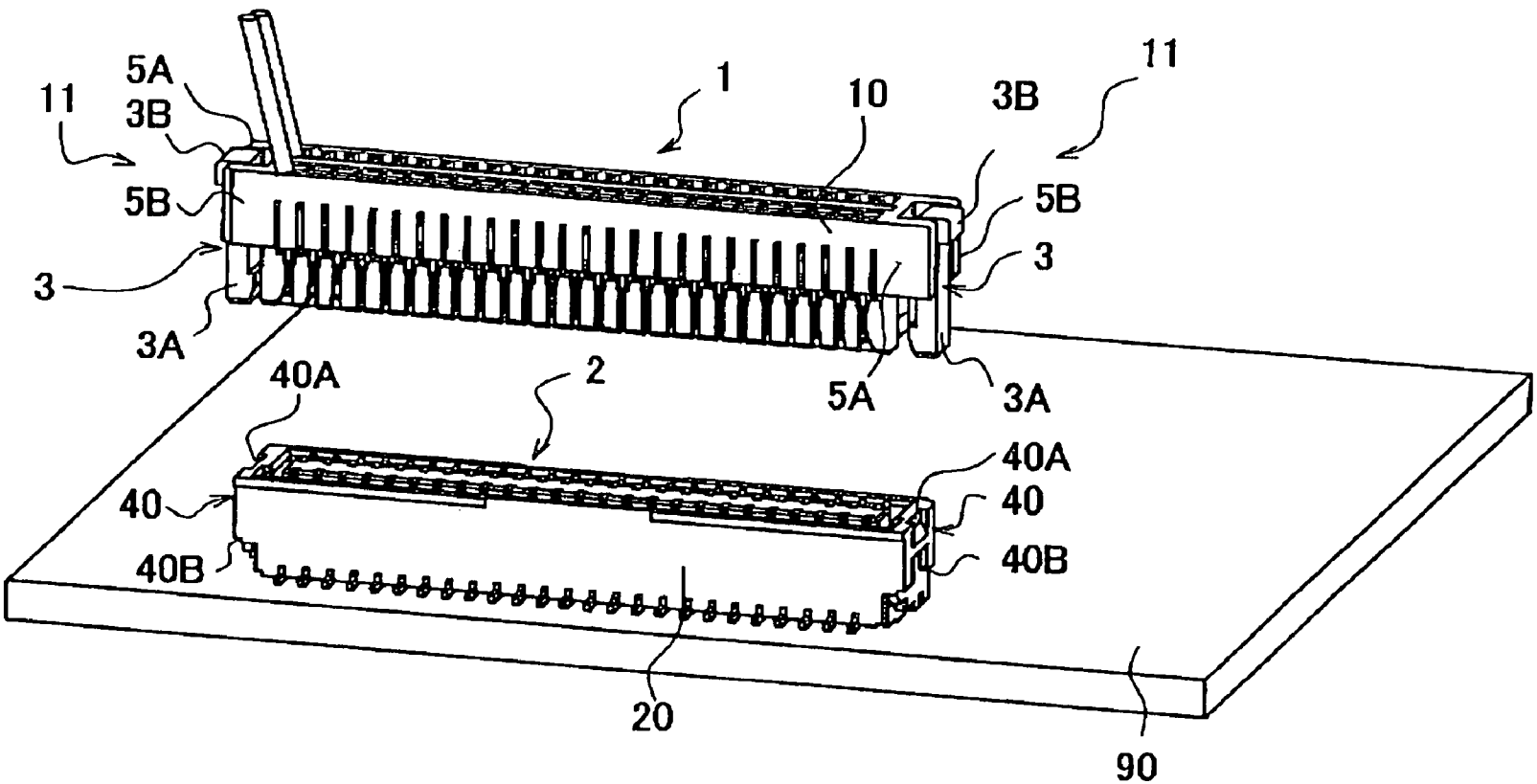
FIG. 2 is a perspective view showing a plug and a receptacle in a state that the plug and the receptacle separated from each other according to the present invention.
Figure 3:
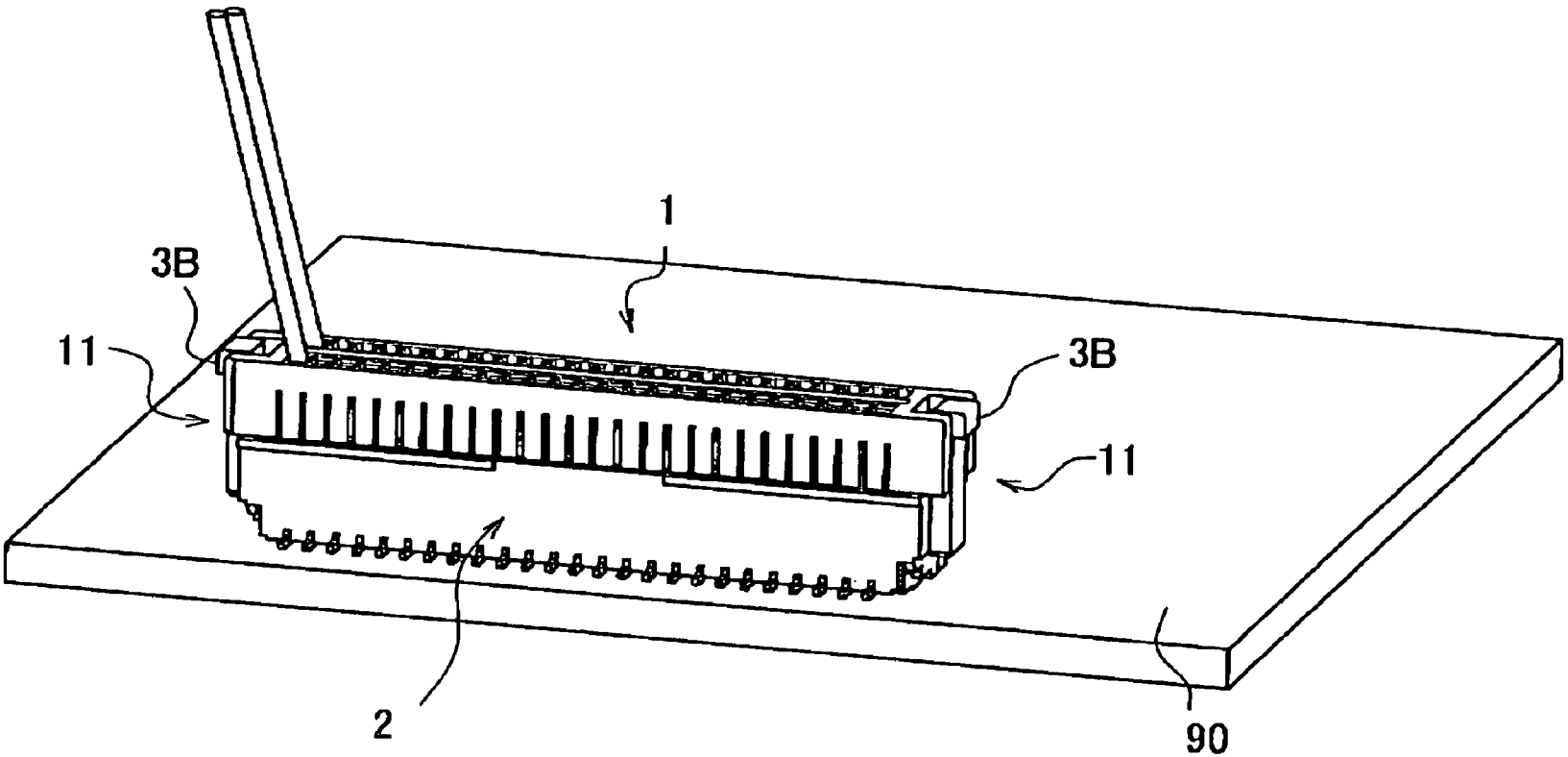
FIG. 3 is a perspective view showing the plug and the receptacle in a state that the plug and the receptacle fitted together according to the present invention.

Subsequently, an embodiment of a connector, to which the lock mechanism according to the present invention is applied, and a mating connector will be described with reference to FIGS. 2 and 3. FIG. 2 is a perspective view showing a plug 1, according to the present invention, and a receptacle 2 with the plug 1 and the receptacle 2 separated from each other. FIG. 3 is a perspective view showing the plug 1, according to the present invention, and the receptacle 2 with the plug 1 and the receptacle 2 fitted together.

In the embodiment shown in FIG. 2, the plug 1 comprises a shell-type multipolar, rectangular connector. A plug housing 10 includes an outer shell molded from an insulating synthetic resin to be rectangular in shape. The plug housing 10 mounts thereto a plurality of plate-shaped contacts with cables.

On the other hand, in the embodiment shown in FIG. 2, the receptacle 2 comprises a shell-type multipolar, rectangular connector, the receptacle 2 comprising a connector for a printed board, which is surface-mounted to a printed board 90. A receptacle housing 20 includes an outer shell molded from an insulating synthetic resin to be rectangular in shape. A plurality of plate-shaped contacts, which are to couple with the plate-shaped contacts mounted on the plug 1, are mounted on the receptacle housing 20.

According to the embodiment, the plug 1 shown in FIG. 2 has a feature that the lock mechanisms 11 having a pair of torque rods 4A and 4B supporting a lock arm 3 at both ends thereof so as to allow a hook 3A to swing are arranged on both wings of the plug housing 10. In the embodiment shown in FIG. 2, the pair of columnar torque rods 4A and 4B (see FIG. 1) have a diameter of 0.6 mm and a length (height) of 0.2 mm.

Further, the plug 1 in the embodiment shown in FIG. 2 has a feature that outer walls of a pair of supports 5A and 5B joined to the pair of torque rods 4A and 4B (see FIG. 1) supporting the lock arm 3 at both ends thereof are flush with both side surfaces of the plug housing 10.

As shown in the embodiment of FIG. 2, the pair of supports 5A and 5B formed to extend contiguous to and project from the both side surfaces of the plug housing 10 in a flanged manner make the both side surfaces of the plug housing 10 flat. By constituting the lock mechanisms according to the present invention in this manner, it is possible to make the plug small in size and height.

Likewise, with the receptacle 2 shown in the embodiment of FIG. 2, latches 40 for engagement with the lock arm 3 are provided on both wings of the receptacle housing 20. With the receptacle 2 shown in the embodiment of FIG. 2, the pair of latches 40 are made flush with both side surfaces of the receptacle housing 20.

As shown in the embodiment of FIG. 2, the pair of latches 40 formed to extend contiguous to and project from the both side surfaces of the receptacle housing 20 make the both side surfaces of the receptacle housing 20 flat, By constituting the receptacle 2 in this manner, it is possible to make the receptacle small in size and height.

With the plug 1 and the receptacle 2 structured in this manner, a user clasps points of pressure 3B, which make a pair of finger depressing portions provided on the lock mechanisms 11, in a fitted state shown in FIG. 3 to be able to separate the plug 1 from the receptacle 2.

Figure 4:
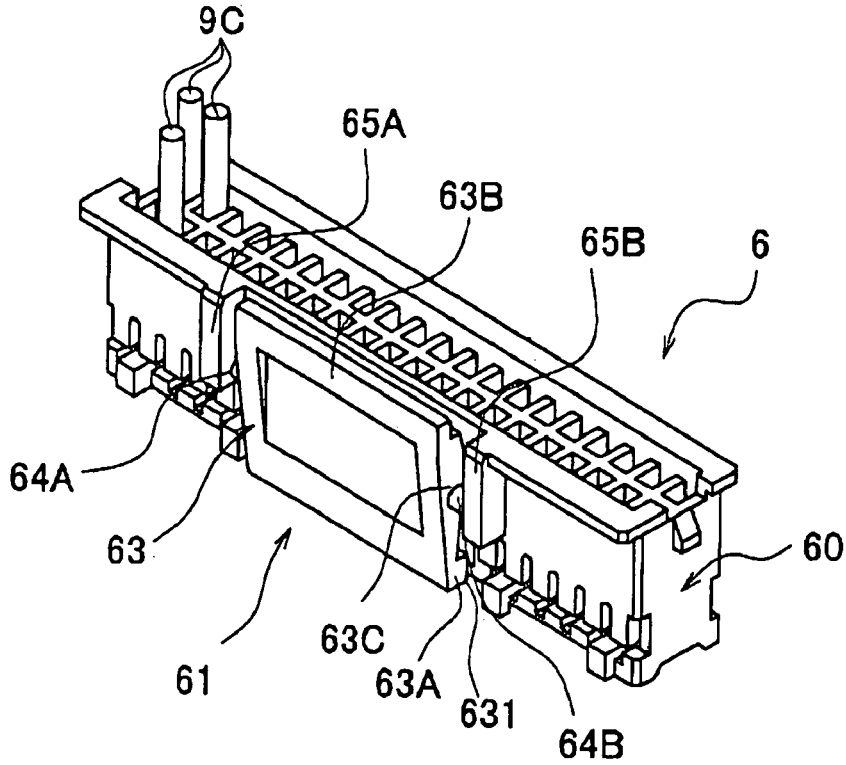
FIG. 4 is a perspective view showing a plug and a receptacle in a state that the plug and the receptacle separated from each other according to another embodiment of the present invention.
Figure 4:
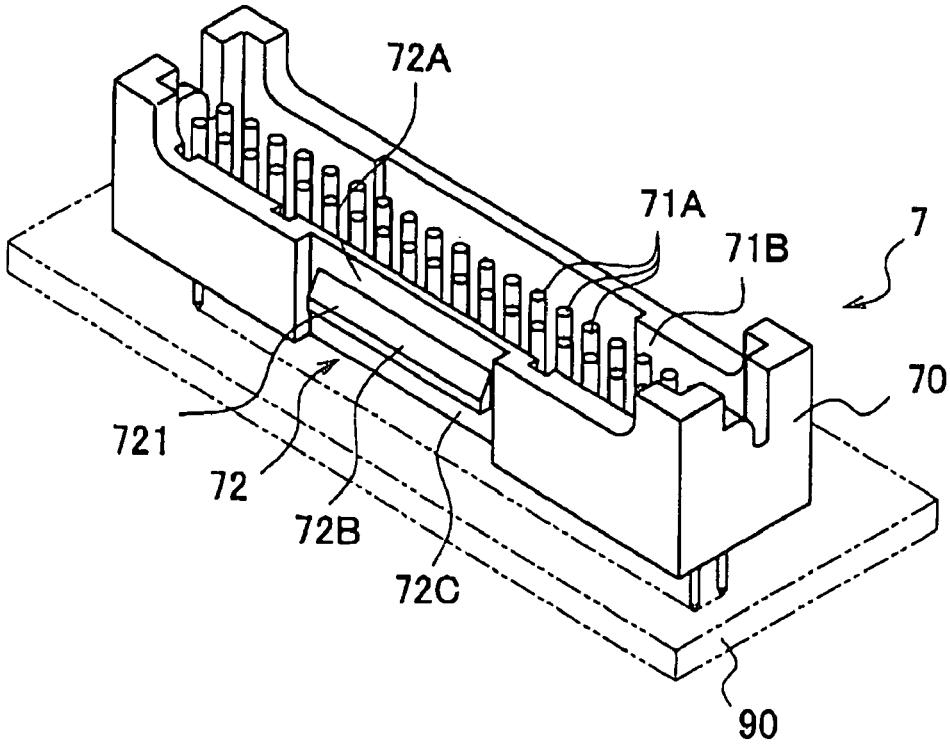

Subsequently, a further embodiment of a connector and a mating connector, to which the lock mechanism according to the present invention is applied, will be described with reference to FIG. 4. FIG. 4 is a perspective view showing a plug 8 and a receptacle 7, according to another embodiment of the present invention, with the plug 6 and the receptacle 7 separated from each other.

In FIG. 4, the receptacle 7 is fixed to a surface of a printed board 90. The plug 6 is mounted to ends of a plurality of cables 9C arranged in parallel. The plug 6 is coupled to the receptacle 7.

The receptacle 7 comprises a receptacle housing 70 made of a synthetic resin and a plurality of terminals 71A. The plurality of terminals 71A extend through the receptacle housing 70 and are arranged in a transverse row. The terminals 71A projecting downwardly of the receptacle housing 70 are fixed at tip ends thereof to the printed board 90 by means of soldering.

The receptacle housing 70 is opened at an end surface on a coupled side thereof and includes an insertion and extraction recess 71B to permit insertion and extraction of a part of a corresponding mating plug 6. The plurality of terminals 71A are aligned and arranged in the insertion and extraction recess 71B.

A mountainous engagement projection 72B is formed on an outer wall surface of the receptacle housing 70. The mountainous engagement projection 72B is latched on and engaged by a hook 63A on a lock arm 63 on a side of the plug 6.

The engagement projection 72B is projectingly formed in a recess 72C formed on the outer wall surface of the receptacle housing 70. A guide 72A is provided forwardly of the engagement projection 72B to receive the hook 63A provided on the plug 6. The guide 72A, the engagement projection 72B, and the recess 72C constitute a latch 72 for engagement with the lock arm 63 provided on the plug 6.

On the other hand, provided on an outer wall surface of the plug housing 60 is the plate-shaped lock arm 63, which is arranged in parallel to the outer wall surface. A fulcrum portion 63C of the lock arm 63 is supported at both ends thereof by a pair of supports 65A and 65B, which are formed on the outer wall surface to project therefrom.

The pair of supports 65A and 65B join a pair of torque rods 64A and 64B to the fulcrum portion 63C of the lock arm 63. The pair of torque rods 64A and 64B twist when the hook 63A swings. A point of pressure 63B 18 positioned on an opposite side to the hook 63A to comprise a finger depressing portion.

In FIG. 4, the plug housing 60, the lock arm 63, the pair of torque rods 64A and 64B, and the pair of supports 65A and 65B are molded integrally with an insulating synthetic resin, for example, PBT or the like. These elements constitute a lock mechanism 61.

In FIG. 4, when the plug 6 is moved in the direction of connecting in order to fit the plug 6 to the receptacle 7, a slope 631 formed on a distal end of the saw-toothed hook 63A slides on and rides over a slope 721 formed on the mountainous engagement projection 72B, so that the hook 63A is opened outward with the fulcrum portion 63C as a center of rotation.

When the plug 6 is further moved in the direction of connecting, elastic return forces of the pair of torque rods 64A and 64B cause the hook 63A to be latched on the engagement projection 72B, so that a state, in which the plug 6 and the receptacle 2 are coupled together, is maintained.

A state, in which the plug 6 and the receptacle 7 are coupled together, can be released by pushing the point of pressure 63B, which make a finger depressing portion, and moving the plug 6 in a direction opposed to the direction of mounting in a state, in which the hook 63A is opened outward with the fulcrum portion 63C as a center of rotation.

The embodiment shown in FIG. 4 has a feature that the lock mechanism 61 supporting the lock arm 63 at both ends thereof by means of the pair of torque rods 64A and 64B so as to allow the hook 63A to swing is arranged on one of the longitudinal outer walls of the rectangular plug housing 60.

Figure 5:
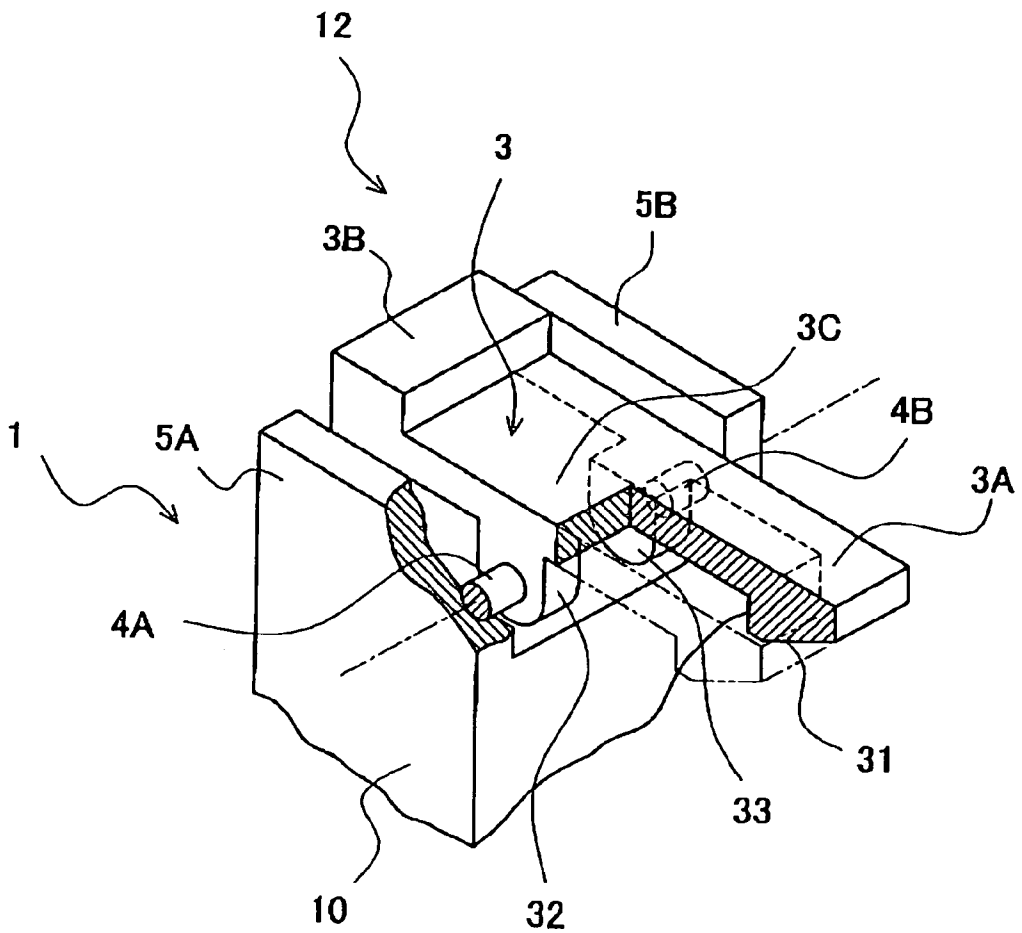
FIG. 5 is a perspective view showing a lock mechanism with a partial cross section according to another embodiment of the present invention.

Subsequently, a further embodiment of the lock mechanism shown in FIG. 1 will be described with reference to FIG. 5. FIG. 5 is a perspective view showing the lock mechanism 12 according to another embodiment. With a part thereof in cross section. In addition, by way of illustration of FIG. 5, constituents denoted by the same reference numerals as those in FIG. 1 are the same in function, and so an explanation therefor is omitted.

In the embodiment of FIG. 5, a pair of flanges 32, 33 are provided on a lock arm 3 below a fulcrum portion 3C of the lock arm 3 in a manner to be opposed to each other. The pair of flanges 32, 33 provided below the fulcrum portion 3C of the lock arm 3 so as to allow a hook 3A to swing are supported at both ends thereof by a pair of torque rods 4A, 4B.

As described previously, since the lock mechanism according to the present invention allows the lock arm to be operated by a relatively weak force, flexure of the hook and the point of pressure, which make a finger depressing portion, is eliminated even when the lock arm is made small in thickness.

With such lock mechanism, by providing the pair of flanges below the fulcrum portion of the lock arm, that is, by lowering the fulcrum portion, a clearance between the point of pressure and an upper wall of the connector can be enlarged, so that an angle, at which the hook opens and closed, can be further increased. This contributes to making a state of being mounted to a mating connector further firm.

The lock mechanism 12 shown in FIG. 5 may be applied to the connector shown in FIG. 2, in which the lock mechanisms are arranged on both wings of the housing, and may be also applied to that connector, in which a lock mechanism is arranged on one of outer walls of a housing.

Figure 6:
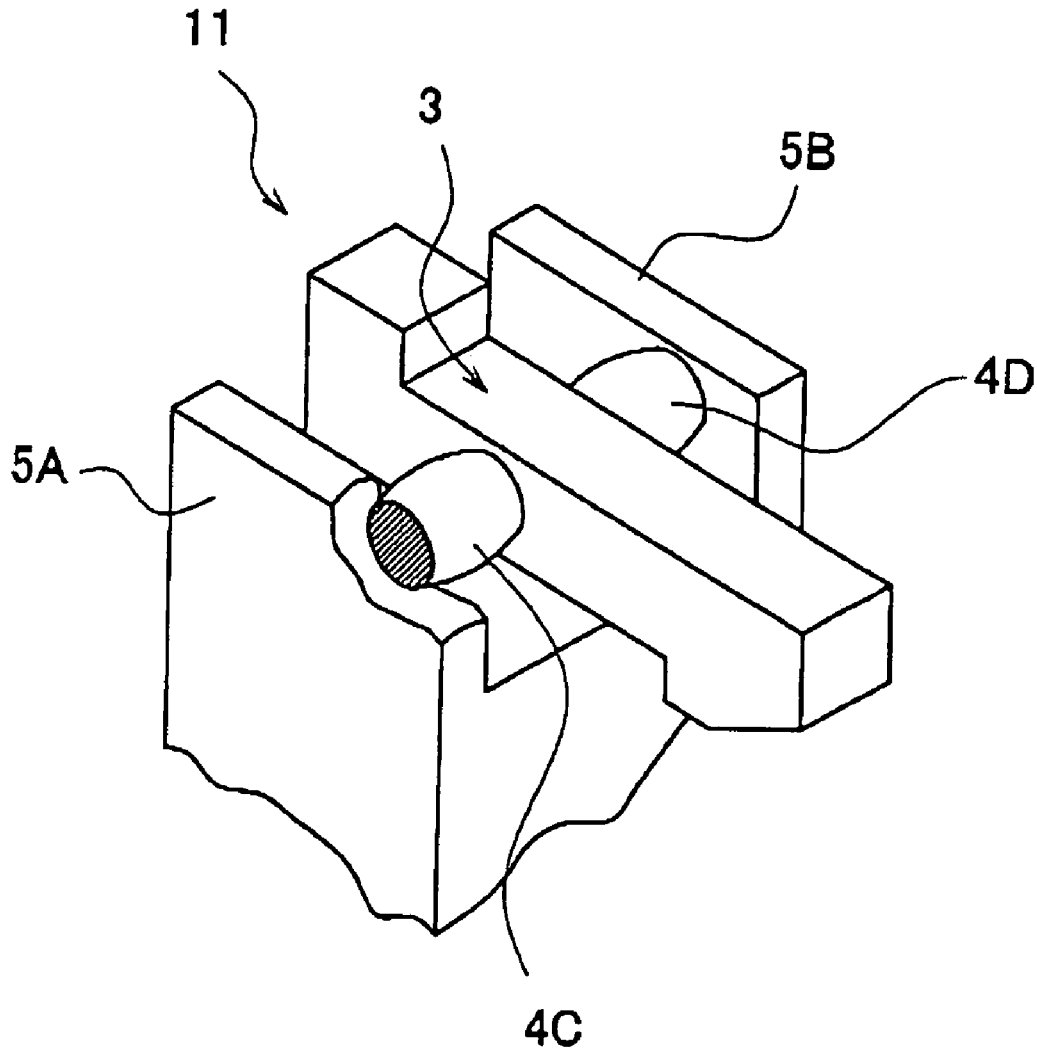
FIG. 6 is a perspective view showing a lock mechanism implementing a pair of bulged torque rods according to the present invention.

Subsequently, an embodiment of torque rods, which replace the pair of torque rods 4A, 4B shown in FIG. 1 or FIG. 5, will be described with reference to FIG. 6. FIG. 6 is a perspective sketch drawing showing a lock mechanism 11 comprising a pair of bulged torque rods.

While the pair of torque rods 4A, 48 shown in FIG. 1 comprise a simple column, a pair of torque rods 4C, 4D shown in the embodiment of FIG. 6 have a feature that the pair of torque rods 4C, 4D comprise a bulged column being larger in diameter at an intermediate portion thereof than at both ends thereof as fixedly supported.

It is known that stress is concentrated on an intermediate portion between both ends of a torque rod applied by a twisting torque, which are securedly supported. The pair of torque rods 4C, 4D shown in the embodiment of FIG. 6 comprise a torque rod composed of a bulged column, thus making stress concentration even.

Figure 7:
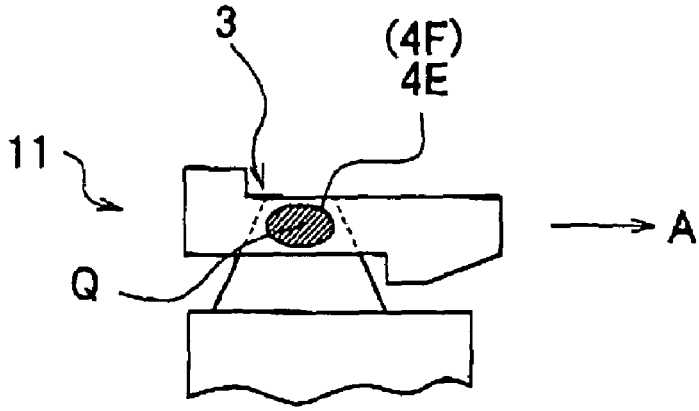
FIG. 7 is a vertical, cross sectional view showing a lock mechanism with a pair of nearly elliptical torque rods according to the present invention.

Subsequently, an embodiment of torque rods, which replace the pair of torque rods 4A, 4B shown in FIG. 1 or FIG. 5, will be described with reference to FIG. 7. FIG. 7 is a vertical, cross sectional view showing a lock mechanism 11 comprising a pair of nearly elliptical columns.

While the pair of torque rods 4A, 4B shown in FIG. 1 or FIG. 5 comprise a simple column, a pair of torque rods 4E, 4F shown in the embodiment of FIG. 7 have a feature that a cross section at an axis Q of the pair of torque rods 4E, 4F forms a near ellipse, of which a major axis is in parallel to a direction (a direction indicated by an arrow A in the figure) of insertion of a mating connector and a minor axis is perpendicular to the direction of insertion of a mating connector, and thus the pair of torque rods 4E, 4F comprise a nearly elliptical column.

Since the pair of torque rods 4E, 4F shown in the embodiment of FIG. 7 comprise a nearly elliptical column, the plug 1 with a lock mechanism, shown in FIG. 2, or the plug 6 with a lock mechanism, shown in FIG. 4 can be made small in size and height.

Figure 8:
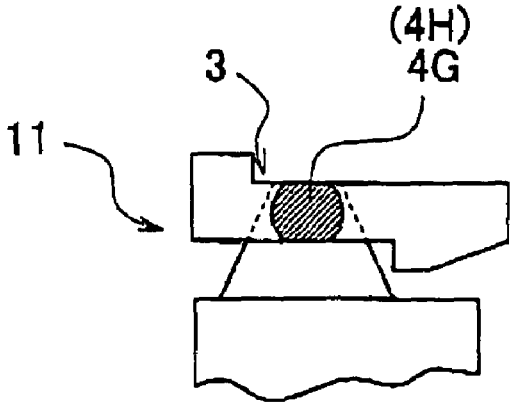
FIG. 8 is a vertical, cross sectional view showing a lock mechanism with a pair of cutoff columnar torque rods according to the present invention.
Figure 9:
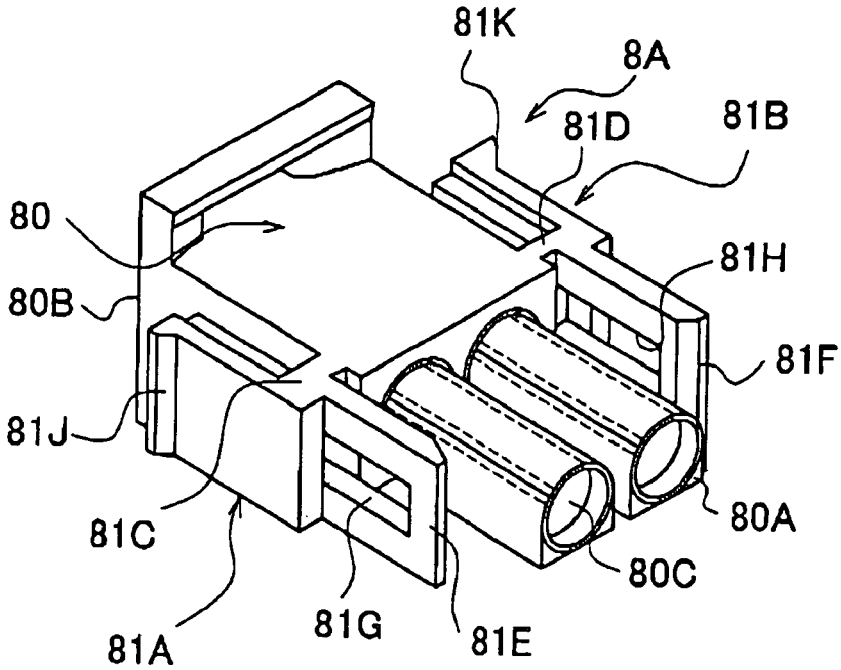
FIG. 9 is a perspective view showing a connector housing including a pair of lock arms joined together by a hinge joint as described in JP-A-5-251135.

Subsequently, a further embodiment of torque rods, which replace the pair of torque rods 4A, 4B shown in FIG. 1 or 5, will be described with reference to FIG. 8. FIG. 8 is a vertical, cross sectional view showing a lock mechanism 11 comprising a pair of cut-off columnar torque rods.

While the pair of torque rods 4A, 4B shown in FIG. 1 or FIG. 5 comprise a simple column, a pair of torque rods 4G, 4H shown in the embodiment of FIG. 8 have a feature that they are in the form of a column, which is cut off arcuately so as to be made flush with an upper surface of a lock arm 3. In addition, the pair of torque rods 4G, 4H shown in FIG. 8 are also cut off arcuately at a lower surface thereof to show a symmetry between the lower surface and the upper surface.

Since the pair of torque rods 4G, 4H shown in the embodiment of FIG. 8 comprise a cut-off column, the plug i with a lock mechanism, shown in FIG. 2, or the plug 6 with a lock mechanism, shown in FIG. 4 can be made small in size and height.

While a connector with a lock mechanism, according to the present invention, has been explained as a connector for electric connection, a connector with a lock mechanism, according to the present invention, in which a lock arm is supported at both ends thereof by torque rods, may be applied to an optical connector for connection of optical elements and optical fibers, and a mating optical connector.

What is claimed is:

1. A connector with a housing and a lock mechanism, the lock mechanism comprising:

a lock arm for maintaining a state of being coupled to a mating connector, the lock arm having a hook, a point of pressure with a finger depressing portion, and a fulcrum;

a pair of torque rods for supporting the lock arm; and a pair of supports for supporting the fulcrum of the lock arm at both ends thereof;

wherein the hook projects in a direction of insertion of the mating connector;

wherein the point of pressure is positioned on an opposite side to the hook;

wherein the fulcrum is positioned between the hook and the point of pressure;

wherein the pair of supports project from an outer wall of the housing;

wherein the lock arm has at least an elliptical or circular cross section, and the lock arm is provided between the supports projecting from the outer wall of the housing to be arranged on both wings of the lock arm;

wherein each of the pair of supports is joined to an end of each of the pair of torque rods;

wherein each of the torque rods is formed in a substantially column shape with a non-angular cross section;

wherein the fulcrum of the lock arm is supported at both sides thereof by the pair of torque rods so as to permit the hook to swing;

wherein the lock arm further has a pair of flanges opposing each other, for being supported by the torque rods; and wherein the flanges are provided under the fulcrum portion at the lateral ends across the lock arm so as to permit the hook to swing.

2. The connector according to claim 1, wherein the housing, the lock arm, the pair of torque rods, and the pair of supports are molded integrally from an insulating synthetic resin.

3. The connector according to claim 1, wherein the lock mechanism is arranged on each side of the housing.

4. The connector according to claim 1, wherein each of the torque rods is formed from a bulged column, which is larger in diameter at an intermediate portion thereof than at both ends fixedly supported.

5. The connector according to claim 1, wherein a cross section at an axis of each of the torque rods is elliptical, of which a major axis is in parallel to a direction of insertion of a mating connector and a minor axis is perpendicular to the direction of insertion of the mating connector, and the pair of torque rods comprise an elliptical column.

6. The connector according to claim 1, wherein each of the pair of the torque rods is a substantially cylindrical column, and wherein a side surface of each of the pair of torque rods is cut off in a longitudinal direction so as to be made flush with an upper surface of the lock arm.

7. The connector according to claim 1, wherein the lock mechanism is provided on both sides of the connector via the supports.

8. A mating connector being coupled to the connector with the lock mechanism as defined in claim 1.

* * * * *